United States Patent [19]

Larson

[11] Patent Number: 4,703,510

[45] Date of Patent: Oct. 27, 1987

[54] ELECTRO-ACOUSTIC TRANSDUCER WITH DIAPHRAGM AND BLANK THEREFOR

[76] Inventor: David A. Larson, 2460 Wisconsin Ave., Downers Grove, Ill. 60515

[21] Appl. No.: 684,389

[22] Filed: Dec. 20, 1984

Related U.S. Application Data

[60] Continuation-in-part of Ser. No. 503,947, Oct. 13, 1983, Pat. No. 4,536,623, which is a division of Ser. No. 389,423, Jun. 17, 1982, Pat. No. 4,491,698.

[51] Int. Cl.[4] ..... H04R 7/02; H04R 9/04

[52] U.S. Cl. ..... 381/196; 381/193; 381/194; 381/202

[58] Field of Search ..... 179/115.5 PV, 115.5 R, 179/115 R, 115 V, 115.5 ES, 115.5 VC, 181 R, 181 F, 178; 181/173, 164

[56] References Cited

U.S. PATENT DOCUMENTS

| | | | |
|---|---|---|---|
| 3,171,904 | 3/1985 | Poutot | 179/115.5 |
| 3,209,084 | 9/1965 | Gamzon et al. | 179/115.5 PV |
| 3,939,312 | 2/1976 | McKay | 179/115.5 PV |
| 4,056,697 | 11/1977 | Heil | 181/164 |
| 4,491,698 | 1/1985 | Larson et al. | 179/115.5 PV |

FOREIGN PATENT DOCUMENTS

| | | | |
|---|---|---|---|
| 887973 | 4/1981 | Belgium . | |
| 482132 | 8/1929 | Fed. Rep. of Germany . | |
| 54-98612 | 8/1979 | Japan | 179/115.5 PV |

*Primary Examiner*—Gene Z. Rubinson
*Assistant Examiner*—Danita R. Byrd

[57] ABSTRACT

The transducer diaphragm includes a folded sheet of thin film material, having printed circuit conductors formed thereon in a Greek or serpentine pattern. The Greek pattern includes an odd number of spaced, parallel, printed conductor lines formed into longitudinal and transverse groups, with return conductors extending around the perimeter of the pattern to complete loops of a voice coil. The sheet is folded to form a plurality of rearwardly extending projections, with the folding being along the center lines of each of the longitudinal groups. In the preferred form of the invention, each one of the projections is generally channel-shaped throughout its length, and has a bight portion interconnecting a pair of leg portions, with a longitudinal conductor in the center of the bight and other conductors in the longitudinal group opposite each other on the leg portions.

18 Claims, 10 Drawing Figures

FIG. 1
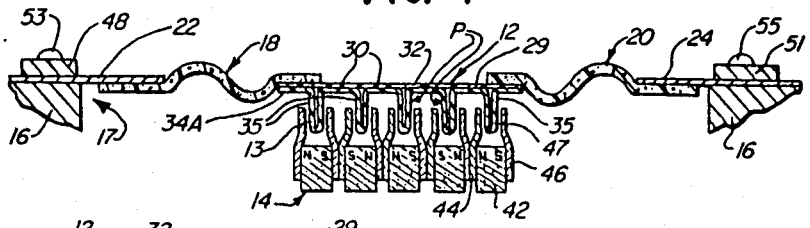
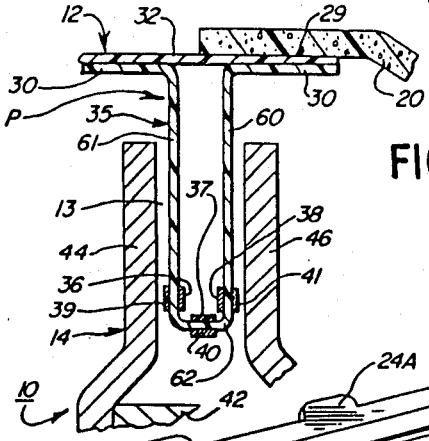
FIG. 2
FIG. 3
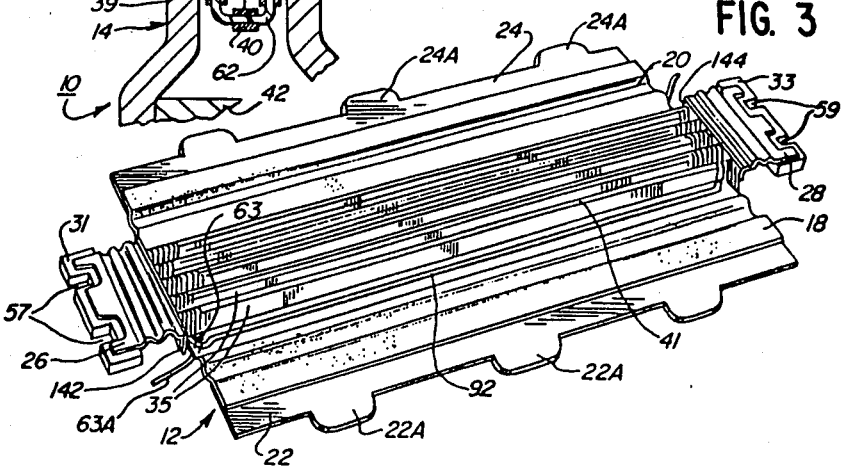
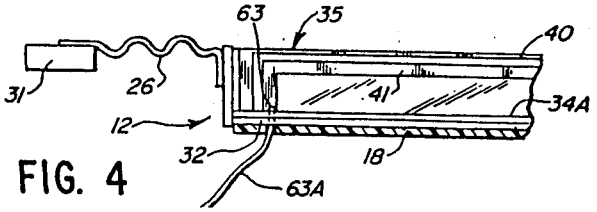
FIG. 4

FIG. 5
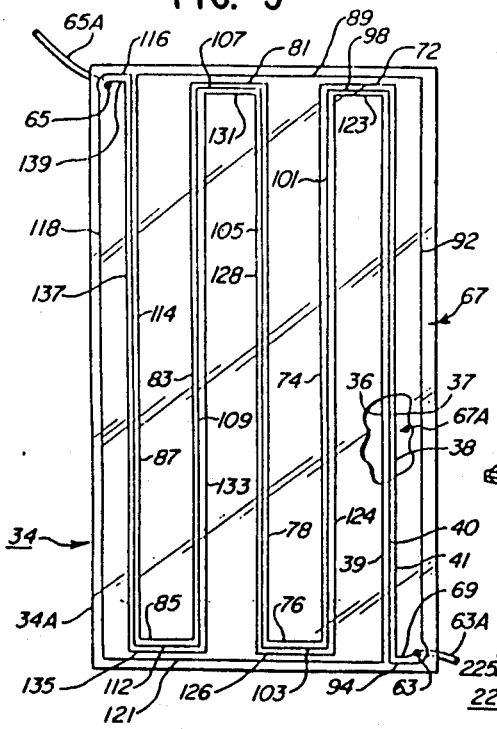
FIG. 7
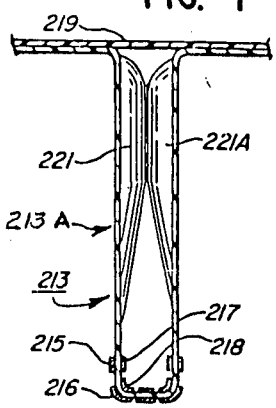
FIG. 8
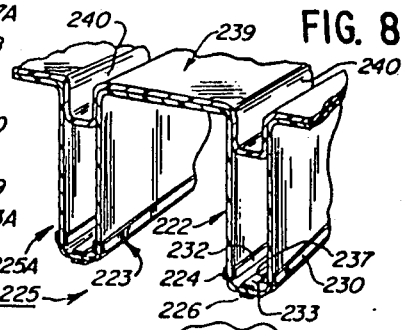
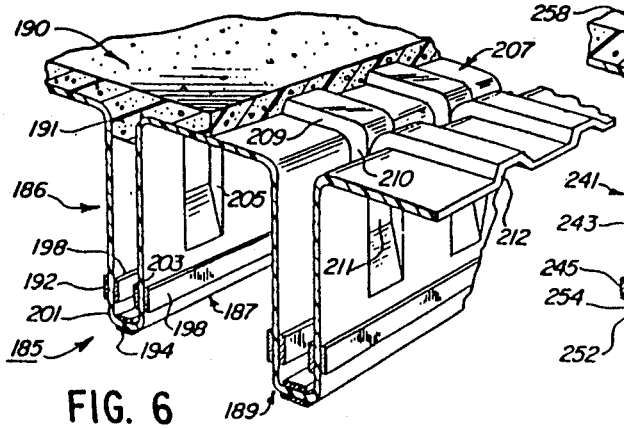
FIG. 6
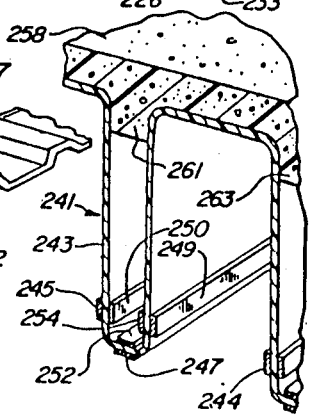
FIG. 9

ELECTRO-ACOUSTIC TRANSDUCER WITH DIAPHRAGM AND BLANK THEREFOR

This is a continuation-in-part of U.S. Ser. No. 503,947, filed Oct. 13, 1983, now U.S. Pat. No. 4,536,623, which was, in turn a division of Ser. No. 389,423, filed June 17, 1982, now U.S. Pat. No. 4,491,698.

TECHNICAL FIELD

This invention relates to electro-acoustic transducers with a flat diaphragm and, more particularly, to wiring patterns for making such transducers with greatly reduced distortion.

BACKGROUND ART

Different types and kinds of electro-acoustic transducers include loudspeakers or microphones, for example. Each one includes a movable diaphragm, which interacts with the surrounding atmosphere either to produce sound waves, or to be set into motion by sound waves. As will becomes apparent to those skilled in the art, the invention relates to either of these types of electro-acoustic transducers. However, for clarity, only loudspeakers will be shown and described herein.

Conventional conically-shaped loudspeakers, by the very shape of the cone, produce distortion in the sound emitted thereby. Such distortion is known as the "cavity effect". Sound propagating from the speaker cone is not emitted uniformly from the surface thereof, because sound waves emitted from the central portion of the cone may be out of phase with the sound emitted from the peripheral portions thereof. As a generality, the latter sound waves travel a shorter distance from the diaphragm to the listener, as compared to the waves emitted from the central portion of the cone.

The specification in the above-identified parent applications identifies a number of prior patents which deal with this problem in different ways. The parent application then described another way of attacking the problem by providing a flat diaphragm with projections on one side for carrying a voice coil into a plurality of spaced parallel gaps in a magnetic structure. This flat diaphragm and magnetic structure greatly reduces, if not completely minimizes, speaker distortion, and yet is highly efficient in operation. Also, the flat piston acts as a true piston, as distinguished from a cone, for example, which may send out arcuate wave fronts. In this regard, the inventive diaphragm is lightweight, and yet has the capability of including an adequate number of voice coil conductors, to obtain satisfactory impedance characteristics. That diaphragm is substantially rigid, to maintain a proper alignment of its conductors within the gaps of its magnetic structure, during operation. Also, the flat diaphragm of the parent application is relatively less expensive to manufacture as compared to other prior art diaphragms.

A further effort has produced a flat diaphragm for use in the structure of the parent invention which is significantly better than other flat diaphragms that may also be used in such structure. In particular, it was found that the aerodynamic design of the flat diaphragm could be improved by providing a better mechanical balance. Ideally, the diaphragm should have a center of gravity at the geometrical center of the diaphragm.

Conceptually, if the diaphragm is cut along any of the infinite number of lines that pass through the center of gravity in the plane of the diaphragm, and if each of the two resulting halves is weighed, each half has precisely the same weight that the other half has. It may not be possible to always provide the ideal weight distribution since nothing is ever that perfect; however, it has been found that the ideal weight may be closely approached by the relatively simple procedure of selecting a particular geometrical pattern of voice coil conductors.

DISCLOSURE OF INVENTION

Therefore, an object of the invention is to provide new and improved electro-acoustic transducers which greatly reduce transducer distortion. Another object is to provide such a transducer with a simple and practical design that insures an accurate and efficient manufacture which enables a low cost production of consistently high quality transducers.

Another object of the invention is to provide such new and improved electro-acoustic transducers with a diaphragm which is relatively lightweight and yet includes a large number of voice coil conductors.

Briefly, the transducers diaphragm includes a thin sheet of material, which may be folded to form a plurality of rearwardly extending projections, fins, or vanes. Each of these projections has at least one voice coil conductor portion disposed thereon. In a preferred emobodiment, the diaphragm is made from a blank, which includes the sheet of insulating film material, preferably having a pair of identical conductor patterns printed on its opposite sides. The pattern is commonly called a "Greek pattern", wherein the conductors move back and forth in relatively long, straight, spaced parallel lines, their ends being joined by relatively short, straight transverse lines which are perpendicular to the long lines, thereby completing a Greek or serpentine pattern.

The ideal weight distribution is achieved by providing an odd number of longitudinal groups of spaced parallel conductors in these Greek or serpentine patterns. Each group contains an odd number of individual conductors. The pattern is completed by return conductors which extend around the outside perimeter of the pattern. There are an even number of the total return conductors, formed by an odd number of return conductors on each side of the Greek or serpentine pattern.

BRIEF DESCRIPTION OF THE DRAWINGS

The above-mentioned and other objects and features of this invention and the manner of attaining them will become apparent, and the invention itself will be best understood by reference to the following description of embodiments of the invention taken in conjunction with the accompanying drawings, wherein:

FIG. 1 is a fragmentary sectional view of the electro-acoustic transducer constructed as taught in the above-identified parent applications;

FIG. 2 is a greatly enlarged, fragmentary detail sectional view of one portion of the diaphragm of the loudspeaker of FIG. 1, illustrating the voice coil and diaphragm inposition in a gap of the driver magnet assembly;

FIG. 3 is a pictorial view of the loudspeaker diaphragm of FIG. 1, illustrating the underside thereof;

FIG. 4 is a fragmentary sectional enlarged elevational view of the end portion of the diaphragm of FIG. 3;

FIG. 5 is a partly schematic face view of a film blank of the diaphragm of FIG. 3, prior to its final folding, illustrating the blank with a portion thereof broken away to show the conductors schematically, as lines for illustration purposes;

FIG. 6 is a fragmentary, sectional pictorial view of a portion of another electro-acoustic diaphragm, which is also constructed in accordance with the present invention, which incorporates corrugations in the top thereof contiguous to the pinched projections thereof;

FIG. 7 is a fragmentary, sectional elevational view of a portion of another electro-acoustic diaphragm;

FIG. 8 is a fragmentary, sectional pictorial view of a further electro-acoustic diaphragm;

FIG. 9 is a fragmentary, sectional pictorial view of a further electro-acoustic diaphragm; and FIG. 10 is the inventive wiring pattern which gives superior performance to the structure of FIGS. 1–9.

BEST MODE FOR CARRYING OUT THE INVENTION

FIGS. 1, 2 and 3 show an electro-acoustic trandsucer in the form of an electro-dynamic loudspeaker 10. The loudspeaker 10 generally comprises a rectangular diaphragm or membrane 12, which coacts electro-magnetically with a series of pole piece gaps 13 of a magnet assembly 14 (FIG. 1). A housing or baffle frame 16 movably supports the diaphragm 12, across an opening 17 therein, in front of the magnet assembly 14. In this regard, a pair of longitudinal flexible surround (suspension) strips 18 and 20 extend transversely from, and are connected to, the opposite side marginal edges of the diaphragm 12. A pair of elongated gasket strips 22 and 24 are connected at their side marginal edges to the respective surround strips 18 and 20 for making a connection to the frame 16.

Each of the gasket strips 22 and 24 includes a series of integral spaced-apart finger tabs 22*a* and 24*a*, respectively, to facilitate the positioning of the gasket strips, and therefore, of the diaphragm and projections P relative to magnet assembly gaps 13. The magnetic assembly is mounted behind an opening 17 within the driver frame 16.

As shown in FIG. 3, a pair of flexible spider connector strips 26 and 28 extend transversely from and interconnect the end, marginal edges of the diaphragm 12 and a pair of generally rectangular end mounting blocks 31 and 33, which, in turn, are adapted to be attached to the frame 16 at the opening 17 therein.

As best seen in FIG. 1, a front surface 29 of a folded sheet 34A is formed by a series of substantially flat portions 30 integrally interconnecting a series of parallel spaced-apart rearwardly extending conductor carrying projections P. Portions 30 are arranged generally in a common plane. The conductor carrying projections P interact magnetically with the permanent magnet assembly 14 to move the diaphragm 12 for producing the desired sound waves.

The interconnecting portions 30 are disposed transversely, substantially at 90°, to the longitudinal axis of the projections P. A backing sheet 32, in the form of a thin film sheet, overlies and is secured to the interconnecting portions 30 to help rigidify the projections and the overall structure of the diaphragm 12. Also, the front face of the sheet 32 provides a substantially smooth, flat surface for the diaphragm 12 to enable it to function with little distortion throughout the entire frequency range.

The sheet 32 is affixed to the interconnecting portions, which provide substantial surface areas to securely attach the sheet 32 to the sheet 34A and its projections P. In this manner, the sheet 32 remains substantially flat during use, to provide the desired frequency response characteristics.

As shown in FIG. 5, the diaphragm 12 (FIG. 1) generally comprises a blank 34 which includes the rectangular sheets 34A of the thin film material. Prior to its folding, sheet 34A is substantially flat. The assembly of the diaphragm 12 includes the folding of the blank 34 to form the series of longitudinally extending spaced-apart, parallel projections P in the form of vanes or fins 35, each of which is an elongated, channel-shaped projection with a generally U-shaped cross section throughout its length. The vanes or fins 35 extend rearwardly toward the magnet assembly 14.

As shown in FIG. 2, a series of inner voice coil conductor portions, such as the conductor portions 36, 37 and 38, are deposited on one side of the film blank 34 and are disposed on the inside of the vanes, such as the vane 35. A series of outer voice coil conductor portions, such as the conductor portions 39, 40 and 41, are deposited on the opposite side of the film blank (FIG. 5) in registration with the corresponding respective conductor portions 36, 37 and 38, and are disposed on the outside of the vanes, such as the vane 35.

As shown in FIGS. 1 and 2, the magnet assembly 14 generally comprises a series of permanent driver magnets, such as magnet 42, which are arranged in a side-by-side configuration, with north and south poles oriented as indicated in the drawings. As shown in FIG. 1, adjacent portions of neighbor magnets have the same polarity. Each one of the driver magnets has a pair of elongate steel pole pieces disposed on the opposite sides thereof, such as the magnet pole pieces 44 and 46 disposed on the opposite sides of the permanent magnet 42. These pole pieces form a series of parallel spaced-apart gaps 47 for receiving the vanes 35 of the diaphragm 12 therein.

During use, the diaphragm 12 vibrates and, thus, the vanes 35 move longitudinally within the pole piece gaps 47, as a result of the dynamic electromagnetic interaction between the current carrying conductor portions on the vanes and the permanent magnet pole pieces. The same oscillating movement of the vanes 35, and attached backing sheet 32 also causes air to be displaced from the gaps 47 for cooling purposes, thereby relieving heat build-up. The harder the diaphragm is driven, the greater the pumping action of the diaphragm, for withdrawing greater quantities of air for cooling purposes. Such a greater flow rate of air is desirable, since heat build-up increases as the diaphragm is driven harder, especially where it is driven beyond desired limits. In some applications (as in a closed parked vehicle in the hot sun), ambient temperatures are high.

In order to attach the surround strips 18 and 20 to the driver frame 16 (FIG. 1), a pair of gasket strip plates 48 and 51 clamp the respective gasket strips 22 and 24 to the frame 16. Screws 53 and 55 fasten the strip bars to the frame 16. As shown in FIGS. 3, screw notches 57 and 59 in the respective mounting blocks 31 and 33 receive the mounting screws (not shown) for fastening the mounting blocks to the frame 16.

As best seen in FIG. 2, each one of the projections P has a pair of leg portions 60 and 61 leading to a bight portion 62. The leg portions are disposed transversely, substantially at right angles, to the bight portion 62. It should be noted that the inner and outer conductors 37 and 40 are disposed directly opposite one another, within the bight portion 62. The conductors 38 and 41 are disposed on opposite sides of the leg portion 60. The conductors 36 and 39 are positioned on opposite sides of the leg portion 61.

The film blank 34 (FIG. 5) is formed generally of any suitable high temperature group of thermoplastic blend material. The preferred material is polysulfone, such as the polysulfone sold under the trademark "UDEL" by Union Carbide of Danbury, Conn. Other suitable compositions include "ULTEM" by General Electric Company; "POLYETHER SULFONE" (polyphenyl sulfone), sold by Imperial Chemical Industries, and "RADEL" (polyphenyl sulfone) sold by Union Carbide. Also, suitable polycarbonates, such as "LEXAN" sold by General Electric Company may be employed. Polyimides may also be employed.

In general, the high temperature thermoplastic material should have a relatively high glass transistion temperature point, as well as a relatively high heat deflection temperature. In this regard, the sheet 34A is annealed and formed to the desired shape. In order to maintain the desired shape, during high temperature operation and even in elevated ambient temperatures, which can occur when the loudspeaker is employed in a closed vehicle parked in the sun, the annealing temperature should be preferably in the range of about 300° F. and 375° F., and preferably about 330° F. when the polysulfone "UDEL" is employed. However, it is to be understood that the materials having lower annealing temperatures may also be employed satisfactorily, but the foregoing temperature range is preferred as well as high temperatures for other materials. The sheet has a thickness of about 3 Mils, and the conductors are about 1 Mil thickness.

The sheet 34A includes a conductor pattern, generally indicated at 67, deposited on the front side of the sheet 34A. This pattern electrically interconnects a pair of terminals 63 and 65. A mirror-image of the conductor pattern, generally indicated at 67A, is deposited on the reverse side of the sheet 34A and is disposed opposite, and in registration with, the conductor pattern 34 on the front side thereof. In this manner, the sheet 34A has a greater tendency to lie flat and not be warped, thereby greatly facilitating the folding thereof into the desired shape, as well as facilitating the storage of the blanks. After being folded along the longitudinal conductors, into the shape as shown in FIGS. 1 and 3, the folded sheet 34A assumes the desired shape, with little or no bowing from end to end. It has been found that if the two conductor patterns are not disposed in registration with one another, the folded sheet becomes bowed from end to end, or it otherwise becomes warped.

The conductor patterns 34 and 34A are electrically connected together, in parallel. In this regard, the terminals 63 and 65 of the pattern 34A on the reverse side of the sheet 34A are electrically connected. As shown in FIG. 4, a terminal wire 63A is soldered to the terminal 63 and its corresponding terminal on the reverse side of the sheet 34A, since the solder and the distal end of the wire 63A or an eyelet (not shown) extend through a hole in the sheet 34A. Similarly, a terminal wire 65A is electrically connected to the terminal 65 and to the corresponding terminal of the conductor pattern 67A.

The conductor pattern 67 (FIG. 5) is a replicated Greek pattern which includes a transverse portion 69 integrally connected electrically at one of its ends to the terminal 63. At its other end, transverse conductor 69 connects to the longitudinal conductor 41, which, in turn, is connected integrally to an outer transverse portion 72. A longitudinal portion 74 extends from the transverse portion 72 to a transverse portion 76. Thus, the portions 41, 72 and 74 comprise a U-shaped portion of the pattern.

Similarly, a longitudinal portion 78 extends between the transverse portion 76 and another transverse portion 81, to complete a U-shaped configuration, comprised of portions 74, 76 and 78. A longitudinal portion 83 extends between the transverse portion 81 and another transverse portion 85 to cause the portions 78, 81 and 83 to assume a U-shaped configuration.

A longitudinal portion 87 integrally connects the transverse portion 85 and a longer transverse portion 89, which integrally connects to a longitudinal portion 92 disposed near the marginal edge thereof. A transverse portion 94 interconnects the conductor portion 92 and the longitudinal intermediate conductor portion 40. The portions 83, 85 and 87 also assume a U-shaped configuration.

The conductor portion 40 interconnects the transverse portion 94 with another transverse portion 98. The portion 98 extends parallel to the portion 72, which, in turn, is disposed between the portion 98 and the transverse longer portion 89.

A longitudinal portion 101 extends between the transverse portion 98 and a transverse portion 103. The portion 101 extends parallel to the portion 74, and the portion 103 extends parallel to the portion 76. A longitudinal portion 105 connects the portion 103 and a transverse portion 107, which, in turn, is disposed parallel to the portion 81.

A longitudinal portion 109, is disposed parallel to the portion 83 and connects the portion 107 and a transverse portion 112. The portion 109 extends parallel to the portion 83 and the portion 112 extends parallel to the portion 85.

A longitudinal portion 114 extends parallel to the portion 87, and interconnects the portion 112 and a short transverse portion 116. A lolngitudinal portion 118 connects the portion 116 and a long transverse portion 121. The portion 118 is disposed near the left margin edge of the blank 34. The portion 121 extends parallel to the bottom marginal edge thereof.

The longitudinal conductor 39 is connected between the long transversely extending portion 121 and a short transversely extending portion 123. A longitudinal portion 124 extends parallel to the portion 101 and interconnects the portion 123 and a transverse portion 126. Similarly, a longitudinal portion 128 extends between the portion 126 and another transverse portion 131.

A longitudinal portion 133 extends between the portion 131 and a transverse portion 135. A longitudinal portion 137 interconnects the portion 135 and a short connecting portion 139, which terminates at the terminal 65.

For convenience of expression, the outside conductors 118, 121, 92, and 89 are herein called "return" conductors and the conductors within the Greek or serpentine patterns 39–41, 72, 98, 123 . . . 85, 112, 135, 87, 114, 137 are called the "active" conductors. The active conductors form the voice coil in the magnetic gaps and the return conductors complete the voice circuit.

As shown in FIGS. 3 and 4, the blank 34 is folded longitudinally to form a series of pleats or projections P, as best seen in FIG. 3. In order to help ridigidy the diaphragm 12, a pair of end strips or walls 142 and 144 are secured to the ends of the folded blank 34, by any suitable techniques, such as by heat sealing, or by the application of suitable adhesives or solvent. As shown in FIGS. 1 and 4, the backing sheet 32 is secured over the front surface 29 formed by the connecting portions 30 of the folded blank 34 to provide a smooth and uninterrupted planar surface, and to add to the overall rigidity of the structure.

FIG. 6 shows another acoustic transducer 185, which includes a diaphragm 186, constructed as taught in the parent applcations and adapted to be driven by a magnet assembly (not shown) similar to the magnet assembly to FIG. 1.

The diaphragm 186 is generally similar to the diaphragm 12 of FIG. 1, and includes a series of spaced-apart, longitudinal projections in the form of vanes or fins, such as vanes 187 and 189, which are channel-shaped throughout their length and U-shaped in cross section.

A backing sheet 190 is secured by any suitable technique, such as by applying a suitable adhesive or by sonically welding, and serves the same purpose as the backing sheet 32. A series of parallel spaced-apart, depending ridges, such as the ridge 191, depends into the upper portions of the vanes, such as the vane 187, for helping to provide a sideward stability thereto. The sheet 190 is composed of a suitable foam material, such as an expanded polystyrene or an expanded polysulfone. The foam sheet 190 is molded to conform closely to the outer configurations of the front portion of the folded film diaphragm 186.

Consider now the vane 187, in greater detail. Each of the other vanes is similar to it and will not be described in any greater detail. A series of three outer voice coil conductors 192, 194 and 198 are deposited on the outer surface of the vane 187 in a manner similar to the deposition of outer voice coil conductors on the diaphragm 12. A series of inner voice coil conductors 198, 201 and 203 are deposited on the inner surface of the vane 187 and opposite the corresponding outer conductors.

In order to help rigidify and maintain stability and positioning of the vane 187, a series of longitudinally spaced-apart gussets or corrugations, such as the gusset 205, are provided in the vane 187. In this regard, the gussets help maintain the longitudinal axis of the vane 187 in a substantially perpendicular orientation relative to the plane of tis backing sheet 219. Thus, the sideward stability of the vane 187 is enhanced. An integral web portion 207 interconnects the vanes, and is provided with a series of parallel spaced-apart ridges or corrugations, such as the ridge or corrugation 209 interconnecting the gusset 205 with a gusset 210 in the side of the vane 189. A gusset 211 in the opposite side of the vane 189 has a shape which is complementary to the shape of the gusset 210 and is heat sealed thereto to provide a rigid structure for the vane 189. A ridge or corrugation 212 in the web portion 207 is continous with the gusset 211. Thus, pairs of opposing complementary inwardly extending gussets (e.g., 210, 211) are connected together by heat sealing or an adhesive to join opposing legs of the projections to stabilize sideward movement of projections.

FIG. 7 shows an acoustic transducer 213, which is also constructed as taught in the parent applications, and which has a diaphragm 213A. The diaphragm 213A is generally similar to the diaphragm 186, of FIG. 6, except for the manner in which the diaphragm 213A is rigidified.

The diaphragm 213A includes a series of parallel spaced-apart elongated projections in the form of fins or vanes, such as the vane 214, which is channel-shaped throughout its length, and is U-shaped in cross section. A series of spaced-apart outer conductors, such as the outer conductors 215 and 216, are arranged at the bottom portion of the vane 214. A series of five parallel spaced-apart inner conductors, such as the inner conductors 217 and 218, are disposed opposite to, and in registration with, the respective outer conductors 215 and 216. These conductors are parallel in the sense that adjacent ones extend side-by-side with a generally constant distance between them throughout their lengths.

A flat backing sheet 219 is secured to the remaining portion of the diaphragm in a similar manner as the backing sheet 146 is secured in place at the front portion of the diaphragm 12. A series of pairs of gussets, such as the gussets 221 and 221A are heat sealed together and are spaced apart along the vane 214 in a similar manner as the gussets of the diaphragm 186 of FIG. 6, except that the gussets do not extend to the upper web portion as in the case of the web portion 207 of the diaphragm 186.

FIG. 8 shows an acoustic transducer 225, which is constructed as taught in the parent applications and which includes a diaphragm 225A driven by a magnet assembly (not shown) similar to the magnet assembly 14 of FIG. 1. The diaphragm 225A is generally similar to the diaphragm 186, with the exception of the backing sheet therefor. The diaphragm 225A includes a series of parallel spaced-apart U-shaped vanes, such as the vanes 222 and 223. Consider now the vane 222 in greater detail, it being understood that the vane 223 is generally similar to it. A series of three outer current carrying conductors 224, 226 and 230 are deposited on the outer surface of the bottom portion of the vane 222 in a manner similar to the way that the outer conductors are attached to the vane 35 of FIG. 2. A series of three parallel spaced-apart inner current carrying conductors 232, 233 and 237 are deposited on the inner surface of the bottom portion of the vane 222 opposite the respective outer conductors.

A backing member 239 is attached thereto in a manner similar to the attachment of backing member 146 to the folded film blank of FIG. 1. The backing member 239 is composed of similar film material, and includes a series of depending channels 240, which extend partially into the inner interiors of the vanes, in a manner similar to the way that depending ridge 191 of the foam backing member 190 extends into the interior space of the vane 187 of FIG. 6.

FIG. 9 shows an acoustic transducer 242, which is constructed in accordance with the present invention, and which includes a diaphragm 241 adapted to be driven by a magnet assembly (not shown) similar to the magnet assembly 14 of FIG. 1. The diaphragm 241 is generally similar to the diaphragm 186 of FIG. 6. except that the diaphragm 241 does not include the gussets therein. The diaphragm 241 includes a series of elongated parallel, spaced-apart, U-shaped vanes, such as the vanes 243 and 244.

Consider now the vane 243, it being understood that the vane 244 is similar to it. The vane 243 includes a series of three outer current carrying conductors 245, 247 and 249 arranged about the outer periphery of the bottom portion of the vane 243. A series of three inner conductors 250, 252 and 254 are spaced about the inner surface of the vane 243, opposite corresponding ones of the outer voice coil conductors and in registration therewith.

A foam backing sheet 258 is disposed in place in a manner similar to the foam backing sheet 190. A series of elongated depending ridges, such as the ridges 261 and 263, are disposed in the upper portions of the interior of the vanes, such as the corresponding vanes 243 and 244. Thus, the ridges 261 and 263 serve the same purpose as the channels 240 of the diaphragm 225A.

It has been found that superior results are produced when a particular type of pattern is used to make the inventive diaphragm and that the best of this type of pattern is shown in FIG. 10, which gives the best mechanical balance to the diaphragm.

In general, there should be an odd-number of longitudinal groups 300–308 of conductors in the Greek or serpentine pattern, itself. This way, one pattern 304 is on a center projection P, and an equal number of longitudinal patterns are on the outboard sides opposite the center. The two transverse adjacent groups 310, 312 and outboard groups 314, 316 are equally offset on opposite ends of the diaphragm and opposing sides of the center projection P carrying group 304.

Each of the five longitudinal groups (300–308) has an odd number of spaced parallel conductors. As seen in FIGS. 6, 7 and 9, this odd number places at least one conductor on the bottom and several directly opposite each other on the sides of the diaphragm fold which forms projection P.

The opposite ends of the voice coil appear at terminals 318, 320 (FIG. 10) which are exactly diagonally opposed to each other. A lightweight, braided, very flexible copper wire is connected to each of these terminals in any suitable manner, such as by solder, for example. When making this connection, care is taken to maintain the balance along this diagonal, with respect to the center of gravity and to keep the connection as light as possible.

It will be observed that it is necessary to return to the start of the Greek or serpentine pattern after each complete loop of a voice coil conductor through all longitudinal and transverse groups. For example, if a single path is traced from terminal 318 through the groups 300–316, it will be found that the path ends at 322. Therefore, a return conductor extending along the perimeter of the pattern takes the path back to 324 where it again enters into the Greek or serpentine pattern. Likewise, if the pattern is traced, the conductor from terminal 320 emerges from the Greek or serpentine pattern at 326. From there, another return conductor extending around the perimeter of the pattern takes the path back to 328 where it reenters the pattern. It is important to note that the return conductors are at locations where they do not enter the magnetic gaps.

There are an odd number of return paths forming each of the groups 330, 332. These two groups "collide" at points 334, 336. The conductor extending between points 334, 336 forms the common center conductor of the longitudinal and transverse groups 300–316.

While this principle may be applied to make any suitable size of a diaphragm, a substantially improved result has been found when the exact pattern shown in FIG. 10 is followed. The width to length ratio of the outside of the entire pattern, including the return conductors, is approximately 2:1. In one embodiment which was built and tested, with excellent results, the pattern was $4\frac{3}{4}$ inches wide and 9-inches long. The exact ratio of this pattern (9 divided by 4.75) is 1:1.895. In this same embodiment, which was built and tested, the film was 10-mils thick, each of the conductors was 30-thousandths of an inch wide, and the space between conductors and within the groups was 10-thousandths of an inch wide. A technique, similar to that used to make printed circuit boards, is used to construct the diaphragm film. Since this technique involves an etching of material which undercuts the conductive material, an "etch factor" should be added to the spacing of the conductors on a mask used to make the diaphragm.

The sheet of film supporting this conductor pattern is folded in the exact centers of the longitudinal groups so that the center conductor of each of these groups is in the bottoms of the projections P (see, FIG. 2).

Mirror image of the pattern is made on opposite sides of the sheet of film, again by a use of known techniques used to make double sided printed circuit boards. The pattern is printed, in exact back-to-back register, on the opposite sides of the sheet of film so that, if the sheet is held up to the light, only one pattern is seen. Suitable connections may be made through or around the film so that the conductors forming the patterns on the opposite sides of the sheet are connected in parallel. The parallel connection is normally preferred since the resistance of the voice coil is effectively reduced by substantially 50% by doubling the conductive path. However, the two patterns could also be connected in series. Impedance matching is important when the length of wires connecting a loudspeaker, for example, into a circuit, becomes significant. Thus, sometimes it may be possible to match impedance merely by selecting between making series and parallel connections of the patterns printed on the opposite sides of the sheet.

Although it is most convenient to use the printed circuit approach to make the inventive diaphragm, other manufacturing techniques may also be used in special circumstances. For example, extremely large diaphragms may be made by stamping the conductive pattern from foil, and then bonding the resulting pattern of foil onto the sheet of plastic material. Or, an implantation process may be used to form conductive strips in extremely small diaphragms. In some cases, wires may be used to form the conductive patterns. When wires are used, a coating is added to bond the wires and film or other supporting substrate into a solid mass.

Those who are skilled in the art will readily perceive how to modify the invention. Therefore, the appended claims are to be construed to cover all equivalent structures which fall within the true scope and spirit of the invention.

The claimed invention is:

1. In an electro-acoustic transducer having magnetic means forming a plurality of spaced-apart longitudinal magnetic gaps, a diaphragm comprising:

a sheet of film having at least one surface with a pattern of conductive strips formed thereon in a Greek pattern of alternating longitudinal and transversing groups of conductors as a conductive coil having an odd number of individual conductors in each of said groups, there being an odd number of said longitudinal groups extending in generally parallel spaced-apart relation from a first end of the sheet to a second end of the sheet, and an even number of said transverse groups extending between said longitudinal groups at said first and second ends to form said Greek pattern;

said sheet being folded to make a plurality of spaced-apart generally U-shaped channels forming elongated projections extending perpendicularly from a back of the sheet opposite the surface upon which the pattern is formed, each fold being made at a center one of the odd number of individual conductors of a group;

said pattern of conductive strips including return conductors extending around the outside perimeter of said pattern of conductive strips for extending each individual conductor in said group to a start of said pattern of conductive strips, there being an odd number of said return conductors on each side of said pattern of conductive strips, and diagonally opposite terminal ends of the conductive coil thus formed, to maintain a balanced weight distribution.

2. The transducer of claim 1, wherein each of said generally U-shaped channels has a bight portion interconnecting a pair of leg portions, and has at least one of said conductor means is disposed in the center of the bottom of said bight portions.

3. The transducer of claim 1 wherein there are five of said longitudinal groups with seven of said spaced parallel conductors in each of said groups.

4. The transducer of claim 3 wherein each of said conductors is approximately 30-thousandths of an inch wide and the space between said conductors is approximately 10-thousandths of an inch wide.

5. The transducer of claim 1 wherein said Greek or serpentine pattern is approximately twice as long as it is wide, said longitudinal groups extending in said long direction and said transverse groups extending in said wide direction.

6. The transducer of claim 5 wherein mirror images of said Greek or serpentine pattern are repeated on opposite sides of said film, said repeated patterns are in back-to-back registry with each other.

7. In an electro-acoustic transducer having magnet means forming a plurality of spaced parallel gaps, a diaphragm comprising:

a sheet of film material folded to have an odd number of spaced parallel elongated projections extending from one side, there being one projection fitting into each of said gaps, each one of said projections having at least one electrical conductor means disposed thereon and extending substantially in alignment and registration with said gap to coact electromagnetically therewith, said electrical conductor being formed on said film in a Greek pattern of conductive strips with an odd number of longitudinal conductor groups and an even number of transverse conductor groups forming said pattern of alternating longitudinal and transversing groups of conductors as a conductive coil having an odd number of individual conductors in each of said groups, there being an odd number of said longitudinal groups extending in generally parallel spaced-apart relation from a first end of the sheet to a second end of the sheet, and an even number of said transverse groups extending between said longitudinal groups at said first and second ends to form said Greek pattern;

said sheet being folded to make a plurality of spaced-apart generally U-shaped channels forming elongated projections extending perpendicularly from a back of the sheet opposite the surface upon which the pattern is formed, each fold being made at a center one of the odd number of individual conductors of a group;

said pattern of conductive strips including return conductors extending around the outside perimeter of said pattern of conductive strips for extending each individual conductor in said group to a start of said pattern of conductive strips, there being an odd number of said return conductors on each side of said pattern of conductive strips, and diagonally opposite terminal ends of the conductive coil thus formed, to maintain a balanced weight distribution.

8. The diaphragm of claim 7, wherein:

each of said electrical conductor means is a group of conductors containing the same odd number of individual conductors, each one of said projections is a generally U-shaped fold formed in said film to make a bight portion interconnecting a pair of leg portions, and a center individual conductor of the longitudinal conductor means being disposed in the center of said bight portions.

9. The diaphragm according to claim 8, wherein:

said bight and leg portions form a channel-shaped member, each of the non-center ones of the individual conductors forming the longitudinal conductor means being opposite another individual conductor of said longitudinal conductor means on said projection.

10. The diaphragm according to claim 9, further including:

a pair of flexible connector strips connected to said folded sheet in opposing corners of said Greek pattern, and at least a pair of return connectors connecting to and extending around a perimeter of said pattern to complete a return path to the start of said Greek pattern.

11. an electro-acoustic transducer diaphragm blank adapted to form an electro-acoustic diaphragm, said blank comprising:

a sheet of thin film of high temperature thermoplastic material having a pattern of conductor means deposited on at least one side of said sheet, said pattern being a Greek pattern with an odd number of longitudinal conductor means interconnected by an even number of transverse conductor means, with return conductors extending around the perimeter of said pattern to complete a voice coil having an odd number of individual conductors in each of said groups, there being an odd number of said longitudinal groups extending in generally parallel spaced-apart relation from a first end of the sheet to a second end of the sheet, and an even number of said transverse groups extending between said longitudinal groups at said first and second ends to form said Greek pattern;

said pattern of conductive strips including return conductors extending around the outside perimeter of said pattern of conductive strips for extending each individual conductor in said group to a start of said pattern of conductive strips, there being an odd number of said return conductors on each side of said pattern of conductive strips, and diagonally opposite terminal ends of the conductive coil thus formed to maintain a balanced weight distribution.

12. The blank of claim 11 wherein said pattern is repeated in mirror image back-to-back register on opposite sides of said film.

13. The blank of claim 11 wherein said high temperature thermoplastic material anneals at a temperature of about 300° F.

14. The blank of claim 11 wherein said material is selected from one of the group consisting of polysulfone, polycarbonates and polyimides.

15. In an electro-acoustic transducer diaphragm, conductor means comprising:

a conductor at least partially arranged in a Greek pattern having an odd number of groups of longitudinal conductor portions, with an even number of return conductor portions extending along the perimeter of said pattern, onehalf of the even number of return conductors on one side of the Greek pattern and the other one-half of the even number of return conductors on the other side of the Greek pattern to complete a conductive path;

said conductor having a geometrical center; and said conductor being so constructed and arranged that its weight is substantially uniformly distributed about its said geometrical center.

16. The conductor means of claim 15, wherein:

said pattern is a replicated Greek pattern having an odd number of replications.

17. The conductor means of claim 16, wherein:

said pattern has two sides, said return conductor portions being arranged with an odd number of said return conductors on each one of the two sides of said pattern.

18. The conductor means of claim 17, wherein:

the opposite ends of said conductor terminate at a pair of electrical terminals disposed in a spaced-apart manner, said terminals being equally spaced from the geometrical center of said conductor and being arranged on an imaginary line extending through said geometrical center.

* * * * *